US010373413B2

(12) United States Patent
Campbell et al.

(10) Patent No.: US 10,373,413 B2
(45) Date of Patent: Aug. 6, 2019

(54) WEARABLE SECURITY APPARATUS

(71) Applicant: Walmart Apollo, LLC, Bentonville, AR (US)

(72) Inventors: Julie Campbell, Bentonville, AR (US); Christopher Soames Johnson, Pea Ridge, AR (US); Jimmie R. Clark, Fayetteville, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 0 days.

(21) Appl. No.: 15/633,881

(22) Filed: Jun. 27, 2017

(65) Prior Publication Data

US 2018/0005469 A1 Jan. 4, 2018

Related U.S. Application Data

(60) Provisional application No. 62/356,795, filed on Jun. 30, 2016.

(51) Int. Cl.
*G07C 9/00* (2006.01)

(52) U.S. Cl.
CPC ..... *G07C 9/00309* (2013.01); *G07C 9/00031* (2013.01); *G07C 9/00071* (2013.01); *G07C 9/00103* (2013.01); *G07C 2009/00095* (2013.01); *G07C 2009/00769* (2013.01)

(58) Field of Classification Search
CPC ..... G06K 19/0716; G06K 19/0723; G06K 19/07762; H04W 8/26; H04W 84/12; H04W 84/18; G07C 9/00031; G07C 9/00309; G07C 9/0007; G07C 9/00103; G07C 2009/00095; G07C 2009/00769
USPC ..... 340/10.42, 5.61
See application file for complete search history.

(56) References Cited

U.S. PATENT DOCUMENTS

| | | | | |
|---|---|---|---|---|
| 8,502,681 | B2 | 8/2013 | Bolling et al. | |
| 8,810,430 | B2 | 8/2014 | Proud | |
| 9,002,944 | B2 | 4/2015 | Lewis et al. | |
| 9,300,925 | B1 | 3/2016 | Zhang | |
| 9,485,266 | B2 * | 11/2016 | Baxley | H04W 4/90 |
| 2003/0174049 | A1 | 9/2003 | Beigel et al. | |
| 2006/0158329 | A1 | 7/2006 | Burkley et al. | |

(Continued)

OTHER PUBLICATIONS

International Search Report & Written Opinion in International Patent Application No. PCT/US17/39361, dated Sep. 13, 2017; 9 pages.

(Continued)

*Primary Examiner* — Vernal U Brown
(74) *Attorney, Agent, or Firm* — Schmeiser, Olsen & Watts LLP; Timothy P. Collins

(57) ABSTRACT

A security system comprises a wearable security apparatus having an electronic display and a storage device that stores data regarding a wearer and a receiver for receiving emergency information; a security scanner at a facility that communicates with the wearable device to receive and decode the stored data to determine a status of the wearer and whether the wearer may enter or leave the facility; and an associate registry that includes registration information regarding the wearer. The security scanner compares the stored data on the wearable device and the registration information in the associate registry to determine whether the status of the wearer is that the wearer is registered.

18 Claims, 6 Drawing Sheets

(56) References Cited

U.S. PATENT DOCUMENTS

| | | | |
|---|---|---|---|
| 2007/0026798 | A1 | 2/2007 | Hoogstra |
| 2014/0089672 | A1 | 3/2014 | Luna et al. |
| 2014/0333412 | A1 | 11/2014 | Lewis et al. |
| 2014/0354427 | A1 | 12/2014 | Rapaport et al. |
| 2015/0227164 | A1 | 8/2015 | Laycock et al. |
| 2015/0350862 | A1 | 12/2015 | Baxley et al. |
| 2016/0050515 | A1 | 2/2016 | Johnson |

OTHER PUBLICATIONS

Benedict, "New NFC Ring: wearable for unlocking mobile devices, transferring data supports 3D printing," 3ders.org, Oct. 8, 2015; 14 pages.
Rian Boden, "MXP and HID Global to enable wearbale devices to unlock doors," NFCWorld.corn, Apr. 20, 2016; 4 pages.
Lee Bell, "Wave and enter: The wearable tech set to kill the password and PIN for good," Wearable.com, Feb. 11, 2016; 6 pages.
Wheeldon, Gavin "How Wearable Tech Can Help Security Professionals," Ifsecglobal.com, Apr. 17, 2015; 7 pages.
Ann All, "Wearable Tech Shakes up Access Control," esecurityplanet.com, Dec. 19, 2014; 3 pages.
International Preliminary Report on Patentability in PCT/US2017/039361 dated Jan. 10, 2019; 8 pages.

* cited by examiner

WEARABLE SECURITY APPARATUS

RELATED APPLICATIONS

This application claims the benefit of U.S. Provisional Patent No. 62/356,795, filed Jun. 30, 2016, entitled "Wearable Security Apparatus," the contents of which are incorporated herein in its entirety.

BACKGROUND

Technical Field

The present inventive concepts relate generally to building security, and more particularly to wearable electronic devices that include notification and location features in addition to granting access to buildings as well as secure areas within buildings.

State of the Art

Corporate and government buildings typically include security measures where employees, contractors, and/or other authorized people are in possession of a badge, tag, or plastic card key that includes magnetic coding which can be used instead of a physical key for opening door locks when read by a scanning device.

The time-consuming effort of scanning a card key and awaiting a result, for example, the opening of a door, slows down traffic for those authorized people entering or leaving the building. This problem is exacerbated during an emergency when building occupants must evacuate the building quickly, and must use a card key to exit the building. Also, conventional card keys may be used by anyone, so a person authorized to use a card key may enter or leave a building and give the card key to a different person who may also enter or leave the building using the same card key as the authorized person.

BRIEF SUMMARY

In one aspect, a security system comprises a wearable security apparatus having an electronic display, a storage device that stores data regarding a wearer, an association device that associates the wearer and the apparatus with each other, a transmitter that outputs a signal that accesses a combination of data regarding identification, authentication, location, and access status of the wearer, and a receiver for receiving emergency information; a security scanner at a facility that communicates with the wearable security apparatus to receive and decode the stored data to determine both a status of the wearer and whether the wearer may enter or leave the facility; and an associate registry that includes registration information regarding the wearer. The security scanner compares the stored data on the wearable security apparatus and the registration information in the associate registry to determine whether the status of the wearer is that the wearer is registered.

In another aspect, a wearable security device comprises a display; a storage device that stores data regarding a wearer; an association device that associates the wearer and the wearable security device with each other; a transmitter that outputs a signal that accesses a combination of data regarding identification, authentication, location, and access status of the wearer; a receiver for receiving emergency information; and a location device for providing a location in the event of a security situation such as an emergency or illicit access.

In another aspect, a security method comprises activating a wearable security apparatus that is part of a security system of a facility; associating a wearer and the wearable security apparatus with each other; entering or leaving a facility with the wearable security apparatus; determining by a security scanner whether the wearer of the wearable security apparatus is authorized to enter or leave the facility; and verifying that another person has not used the wearable security apparatus to enter the facility.

DETAILED DESCRIPTION OF EMBODIMENTS

In order to improve security in a building with respect to an authorized entry and exit of the building, improved access controls are desired.

In some embodiments of the present inventive concepts, a security system includes a wearable security apparatus that provides access to a building by the wearer, for example, unlocks a door or the like if the wearable security apparatus is activated, the wearer is authorized to use the wearable security apparatus for entering or leaving the building or a secure location in a building, and the wearable security apparatus has a known status with respect to a current use to enter or exit the building, or more specifically, the wearer has not recently used the security apparatus to gain access to the building and is not currently in the building.

The security system prevents an authorized user of the wearable security apparatus from providing the security apparatus to another person who may otherwise not be authorized to enter the building or who may be authorized to enter the building with a different wearable security device but who has a fraudulent desire to use the authorized user's wearable security apparatus to enter the building.

Additional features can be added in order to notify building occupants via the wearable security device of emergencies, building lockdowns, or other events. For example, the wearable security apparatus may include one or more light emitter diodes (LEDs) which emit a particular color corresponding to a type of emergency that is known to the wearer, for example, flashing red indicating an instruction to immediately exit the building.

Another feature may include the ability of the security system to track the location of a wearer of the wearable security device who may be in a building in the event of an emergency.

Figure 1A:
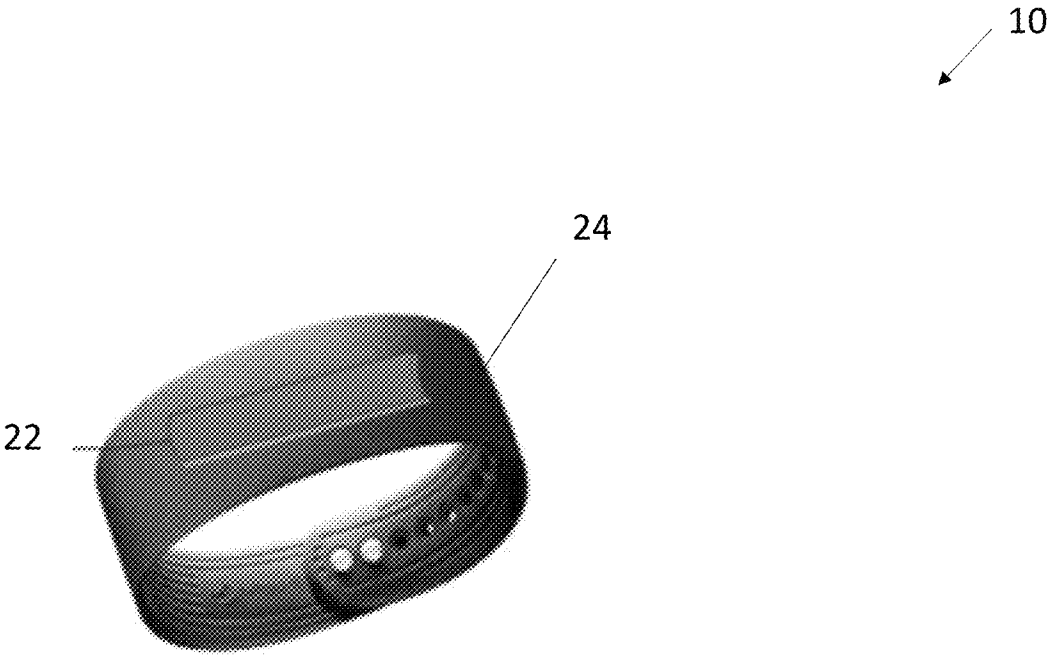
FIG. 1A is a perspective view of a wearable security apparatus, in accordance with some embodiments.
Figure 1B:
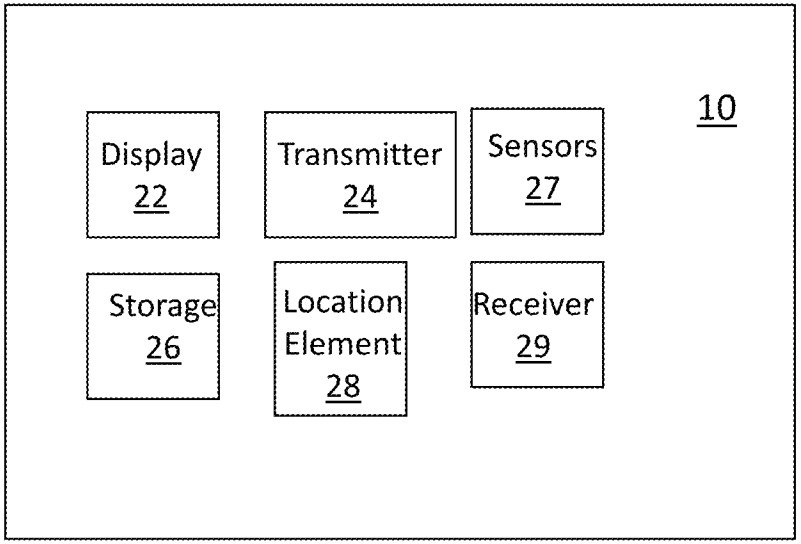
FIG. 1B is a block diagram of the wearable security apparatus of FIG. 1A.

FIG. 1A is a perspective view of a wearable security apparatus 10, in accordance with some embodiments. FIG. 1B is a block diagram of the wearable security apparatus 10 of FIG. 1A.

The wearable security apparatus 10 includes an electronic display 22, a transmitter 24, a receiver 25, a storage device 26, one or more sensors 27, and a location device 28, but not limited thereto. For example, other components of the security apparatus 10 may include an audio speaker, camera or other sensor, biometric reader such as a fingerprint scanner, computer processor, operating system, and so on (not shown).

The display 22 may include a liquid crystal display (LCD) or other screen for displaying a sequence of text, graphics, or other computer-generated display items, for example, which may be used to notify the wearer of an emergency, an authentication result, or other safety or security-related information. The display 22 may also display a result, for example, whether the device 10 is activated, whether the wearer is registered, and/or whether the wearer is checked-in.

In some embodiments, the display 22 includes a plurality of LEDs that emit one or more colors corresponding to various security-related events. For example, an emitted color may establish a level of access or entry by the wearer depending on the emergency. For example, an LED emitting a blue light may indicate a bomb threat. In other embodiments, tactile sensors, audio speakers, and/or other output devices may be part of the wearable electronic apparatus 10 instead of or in addition to the display 22 for communicating to the wearer security-related information. For example, alarms, lights, beacons, and so on may be output according to an emergency code shown in FIG. 5.

The transmitter 24 and receiver 25 are constructed and arranged to exchange data with other electronic devices, and may communicate according to a communication protocol such as a near field communications (NFC), radio frequency identification (RFID), Bluetooth, or the like. For example, the transmitter 24 may transmit data that establishes an identification of the wearable security apparatus 10 and/or identifies and authenticates the wearer of the wearable security apparatus 10. For example, the wearable security apparatus 10 may include a unique ID code which is stored at an electronic memory or storage device 26 of the wearable security apparatus 10. The apparatus 10 may include an association device, for example, a separate hardware processor, or a computer device co-existing with other hardware, that associates the wearer and the apparatus with each other using the ID code. The ID code and/or other data collected by the wearable security apparatus 10 regarding an identification of the wearer, e.g., biometric data, may be part of a record used to authenticate the wearer. In another example, the transmitter 24 may transmit data that may be used for establishing a location of the wearable security apparatus 10, for example, a beacon signal that is received by a location device such as a beacon detector in the building. A signal output by the transmitter 24 may include a combination of data regarding the foregoing, for example, data regarding identification, authentication, location, and/or access status. In some embodiments, this combination of data is stored at the storage device of the wearable device, and accessible by sensors, transmitter/receiver devices, and so on. In some embodiments, this combination of data is stored remotely from the wearable device and accessible using the unique ID of the wearable device.

The receiver 25 may process received data regarding an emergency. In response, the display 22 may display a color code corresponding to the emergency, the sensors 27 may produce tactile feedback, and/an audio speaker may output a sound that informs the wearer of the emergency.

The sensors 27 may include tactile sensors, motion sensors, heat sensors, or a combination thereof that sense the presence of a wearer's body when the device 10 is placed on body, for example, about the wrist.

The location device 28 provides location transmissions and other network communications with respect to the wearable security apparatus 10 user's mobile electronic device 14, for example, to track a location of the wearer in the building. The location device 28 may communicate with location detectors (not shown) in the building.

Figure 2:
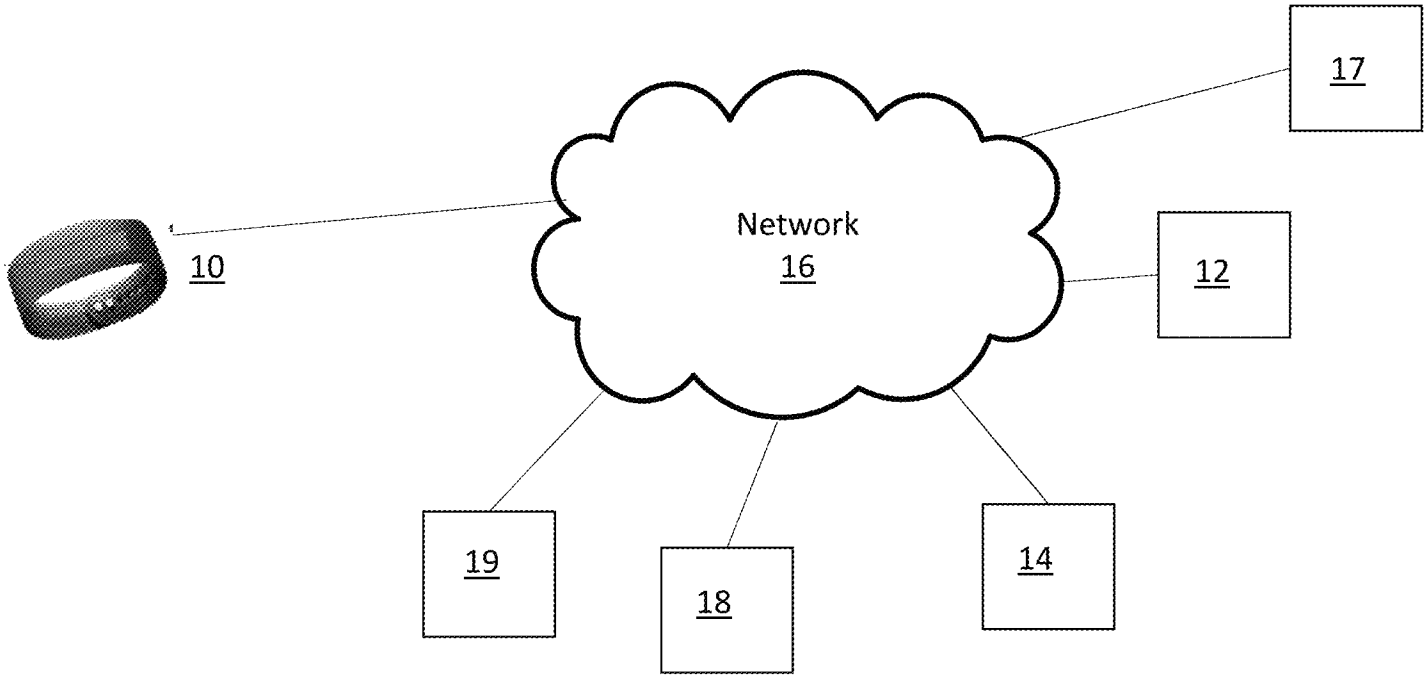
FIG. 2 is a network diagram illustrating an environment in which a security system including the wearable security apparatus of FIG. 1 can be practiced, in accordance with some embodiments.

FIG. 2 is a network diagram illustrating an environment in which a security system including the wearable security apparatus 10 can be practiced, in accordance with some embodiments.

The environment includes a communications network 16 that permits the various electronic devices of the environment to communicate with each other. The network 16 may be a public switched telephone network (PSTN), a mobile communications network, a data network, such as a local area network (LAN) or wide area network (WAN), or a combination thereof, or other communication network known to those of ordinary skill in the art.

Security system environment elements may include but not be limited to one or more of the wearable security apparatus 10, a security scanner 12, an associate registry 14, a notification engine 17, an authentication server 18, and an active wearable database 19, which may communicate with each other and/or other relevant electronic devices via a network 16.

The security scanner 12 is constructed and arranged to receive and process an electronic signal output from the wearable security apparatus 10, or from data stored at the apparatus 10. Scanning devices 12 can be placed in or near the building, for example, under the floor, above an entrance door, and/or other location for scanning the wearable security apparatus to establish whether the security apparatus is active, e.g., usable, and that wearer the wearer is authorized to enter the building. The signal may include a unique identification (ID) of the device 10, authentication data regarding the wearer of the wearable security apparatus 10, location information, or a combination thereof. The security scanner 12 may communicate with the wearable security apparatus 10 according to well-known communication protocols such as RFID, NFC, Bluetooth, and the like. For example, the security scanner 12 can decode data provided in electronic signals received from the wearable security apparatus 10, and output the decoded device ID to the authentication server 18 along with an identification of the door or other location where the wearer wishes to enter to the authentication server 18, which can determine whether the wearer is authorized to enter the desired location.

In addition to security scanners, the security system may include a plurality of location detectors positioned throughout a building at which the wearable security apparatus 10 may be used to gain entry. In some embodiments, the location detectors may utilize technologies such as WiFi triangulation, Visible Light Communication (VLC), Bluetooth™ Low Energy (BLE), Global Positioning System (GPS), Near-Field Communication (NFC), beacon technology, and/or any other suitable positioning technology. It will be understood that the location detectors in communication with the location device 28 of the wearable security apparatus 10 may employ a plurality of positioning technologies, e.g. depending on the level of granularity required, or to provide a fall back in case of technical problems. The wearable security apparatus 10 may pick up location-related transmission and communicate back to location detectors the location of the wearer.

The associate registry 14 may include a plurality of records that each includes information regarding building occupants, for example, company employees or associates. For example, the associate registry 14 can store names, addresses, phone numbers, contact information, and/or other data. Identification information such as digital photographs, fingerprints, and/or other biometric data may also be stored at the associate registry. The occupant record may include a link to the wearable device unique ID. The link may be established by the wearable device 10 including encryption technology such as encryption software stored therein that may allow a unique ID to be generated to which the wearable device 10 is associated with. The device 10 captures a wearable device signature and establishes a record within the database. A wearer is deemed registered if the wearer's name or other identification is in the associate registry 14. In some embodiments, an unauthorized user of the security device 10 is prevented from accessing the building due to a three-factor authentication process, including the need for the user to provide a user identification and password, and/or other security information such as biometric fingerprint or the like, as well as a comparison between the unique ID of the device 10 and the authorized wearer's information stored at the associate registry.

The authentication server 18 determines whether the wearable security apparatus 10 has been used by a wearer to enter or leave the building at which the device 10 is configured to permit access. The authentication server 18 may include a database comprising a set of records, the contents of which are used to determine a wearer's status, i.e., registered, checked in or entered building, left building, and so on. Each record may also link a device ID and door ID to establish that the wearable security apparatus 10 can be used to unlock the door or otherwise access the building at a location where the door ID is associated. In particular, the authentication server 18 may include a record that links a device ID and a door ID at a lobby of the building where people enter. The authentication server 18 can, for example, store in the database a record for each of 1000 building occupants, each record created or updated as wearers enter the building. This data can be used to confirm the identity of each wearer and the authorization of each wearer to use a particular wearable security apparatus 10, and to ensure that the wearer is registered, and authorized to enter the building, and to further ensure that the same wearable security apparatus 10 is not used to authorize multiple or different wearers. Also, the location device 28 embedded or otherwise part of the wearable security apparatus 10 may be used to track a location of the wearer in the building, and this data may confirm the authorized location of the wearer. When a door ID and device ID are received by the authentication server 18 after the wearer scans the device 10 at a scanner 14 at the lobby door, a match is made. The authentication server 18 may receive data from the security scanner 12 indicating that the wearable security apparatus 10 was used to enter or leave the building or a secure location within the building, and provides a response to the security scanner 12 whether the wearer is authorized to enter or leave the building or a secure location within the building. This is performed by the authentication server 18, which can compare the stored data on the wearable security apparatus 10, in particular, the occupant record and the linked device ID stored in the associate registry 14 to determine the status of the wearer, in particular, whether the wearer is registered, e.g., the wearer is authorized to enter or leave the building or a region in the building at which the wearable security apparatus 10 is configured to allow access.

The active wearable database 19 includes identification data regarding the wearable devices that are active, i.e., provided to wearers and registered to permit wearers to enter a particular location. The database 19 may also store a current status of wearers, for example, whether the wearers are in a building or have left the building. Accordingly, an emergency notification, for example, a fire alarm, may be generated. In doing so, an authority such as a fire marshall may determine who is in the building and whether those wearers have left the building. The active wearable database 19 can be referenced by the notification engine 17 to determine who has not left the building when the fire alarm is activated, whereby the notification engine 17 can send a message or other signal to the wearable device 10 of those wearers who have not left the building. Also, the wearable device 10 may emit a beacon, i.e., light and/or audio that can be seen and/or heard by emergency responders searching for the wearer. The light and/or audio may emit a different output, depending on the code. For example, a light frequency that cuts through smoke may automatically be emitted from the wearable device 10 for viewing by the emergency responder through thick smoke when an emergency code 302 and corresponding notification indicates that a fire has occurred, which is distinguished from a bomb threat, where a different light or audio signal is generated.

Figure 3:
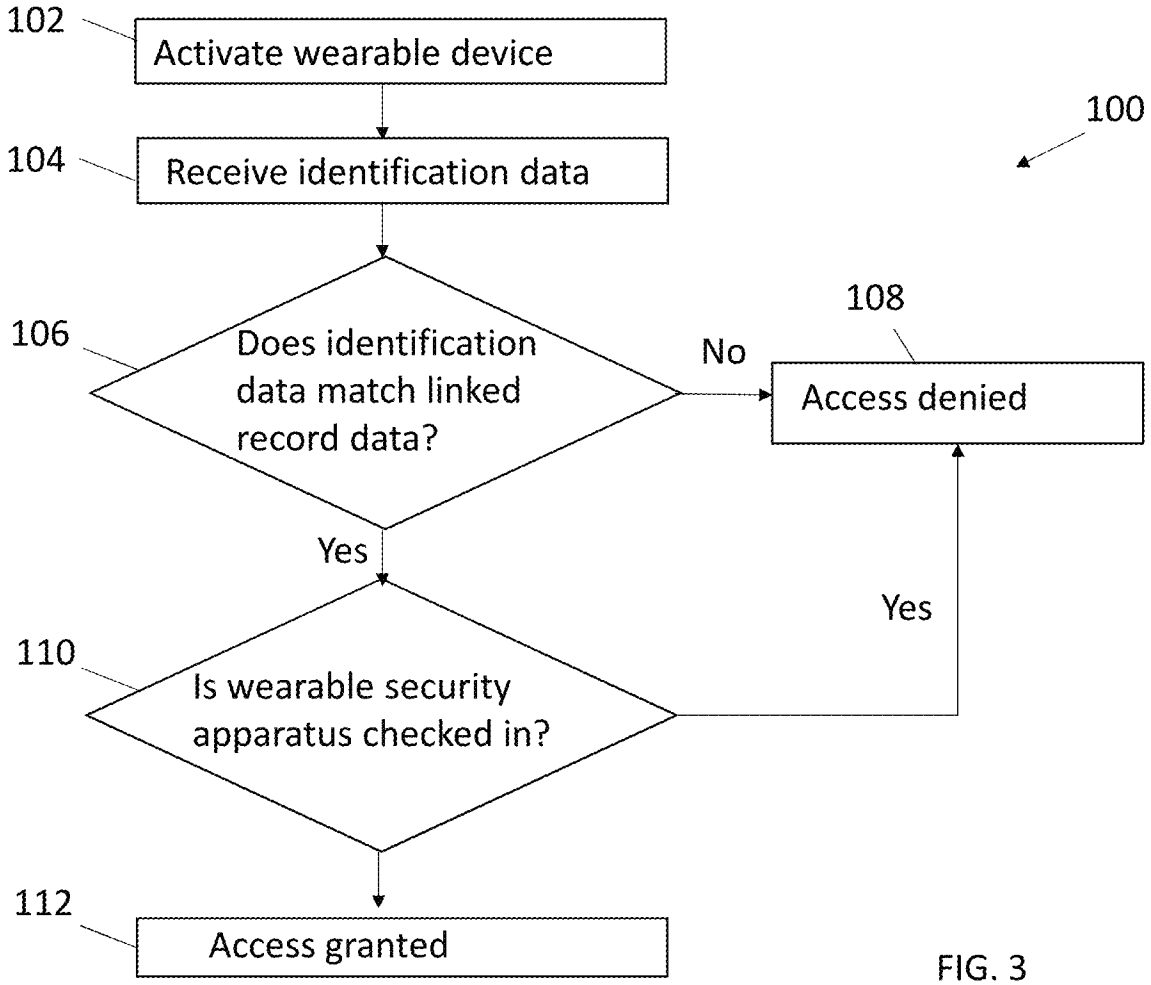
FIG. 3 is a flowchart of a method for an electronic check-in of a wearable security apparatus, in accordance with some embodiments.

FIG. 3 is a flowchart of a method 100 for an electronic check-in of a wearable security apparatus 10, in accordance with some embodiments. The method 100 when executed allows an authorized wearer to, and prevents another person from, using the particular wearable security apparatus 10 to enter a building. In describing the method 100, reference may be made of elements of FIGS. 1A, 1B, and 2.

At block 102, a user activates a wearable security apparatus 10. For example, the user may turn on or enable power so that the wearable security apparatus 10 can communicate with other electronic devices in the security system environment of FIG. 2. As described herein, identification data such as a fingerprint, voice sample, username/password, and so on may be stored at the associate registry 14. The user may activate the wearable security apparatus 10 by providing a fingerprint, voice sample, login information (username/password), PIN, and other identification type, which is compared to the pre-stored identification data. When activated, the wearable security apparatus 10 may be logged into the security system. Also, the entry of an identification type such as a PIN and so on establishes that the wearer is permitted to use the wearable security apparatus 10 to enter and leave the building. Also, when initialized or activated, the wearable security apparatus 10 outputs its device ID for receipt by a local security scanner 12.

At block 104, a security scanner 12 receives the device ID from the wearable security apparatus 10 and/or other identification data, e.g., PIN and so on, and directs the received identification data to the associate registry 14. The associate registry 14 at decision diamond 106 compares the received data to the linked record data corresponding to the wearer and corresponding wearable device to verify whether the wearable security apparatus 10 is registered, e.g., listed in the associate registry 14 and authorized to enter or leave a location. A determination may also be made whether the wearer is linked to the wearable security apparatus 10, i.e., authorized. The device 10 may be registered to the wearer via biometrics, e.g., fingerprint, or login or other authentication scheme. In some embodiments, registration and authorization are performed under the same step.

If at decision diamond 106 a determination is made that the wearable security apparatus 10 is not registered, then the method 100 proceeds to block 108 where access is denied, for example, a door is not unlocked. Otherwise, the method 100 proceeds to decision diamond 110, where a determination is made whether the wearable security apparatus 10 is checked in, i.e., the active registry 19 indicates that the wearable security apparatus 10 has a current status that the wearer is in a building. If a determination is made at the authentication server 18 that a previous check-in occurred with the wearable security apparatus 10, then the method 100 proceeds to block 108, where access is denied. Otherwise, the method 100 proceeds to block 112 where access is granted.

Figure 4:
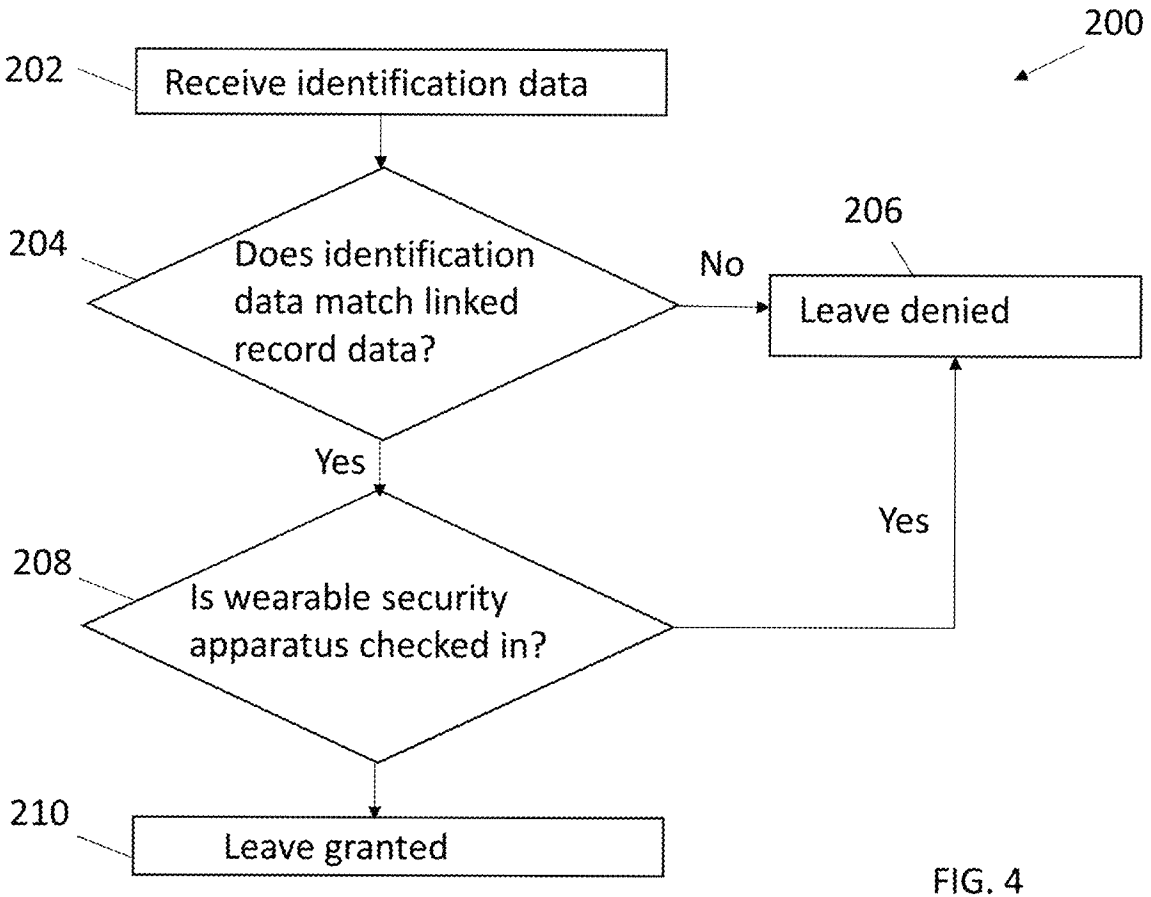
FIG. 4 is a flowchart of a method for an electronic check-out of a wearable security apparatus 10, in accordance with some embodiments.

FIG. 4 is a flowchart of a method 200 for an electronic check-out of a wearable security apparatus 10, in accordance with some embodiments. In describing the method 200, reference may be made of elements of FIGS. 1A, 1B, and 2. Some steps of the method 200 may be similar to or the same as counterpart steps in method 100 described with reference to FIG. 3.

At block 202, the security scanner 12 receives the device ID from the wearable security apparatus 10 and/or other identification data, e.g., PIN and so on, and directs the received identification data to the associate registry 14.

At decision diamond 204, the associate registry 14 compares the received data to the linked record data corresponding to the wearer and corresponding wearable device to verify whether the wearable security apparatus 10 is registered, e.g., listed in the associate registry 14 and authorized to enter or leave a location. A determination may also be made whether the wearer is linked to the wearable security apparatus 10, i.e., authorized. In some device registration and wearer authorization are performed under the same step.

If at decision diamond 204 a determination is made that the wearable security apparatus 10 is not registered, then the method 200 proceeds to block 206 where a request to leave the location is denied. Otherwise, the method 200 proceeds to decision diamond 208, where a determination is made whether the wearable security apparatus 10 is checked in, i.e., the active registry 19 indicates that the wearable device 10 has a current status that the wearer is in a building. If a determination is made at the authentication server 18 that a previous check-in occurred with the wearable security apparatus 10, then the method 100 proceeds to block 108, where access is denied. Otherwise, the method 100 proceeds to block 112 where access is granted.

Otherwise, the method 200 proceeds to decision diamond 208, where a determination is made whether the wearable security apparatus 10 is checked in, i.e., the active registry 19 indicates that the wearable device 10 has a current status that the wearer is in a building. If a determination is made at the authentication server 18 that a previous check-in occurred with the wearable security apparatus 10, the method 200 proceeds to block 206, where the request to leave the location is denied. Otherwise, the method 200 proceeds to block 210 where permission is granted to leave the location.

Figure 5:
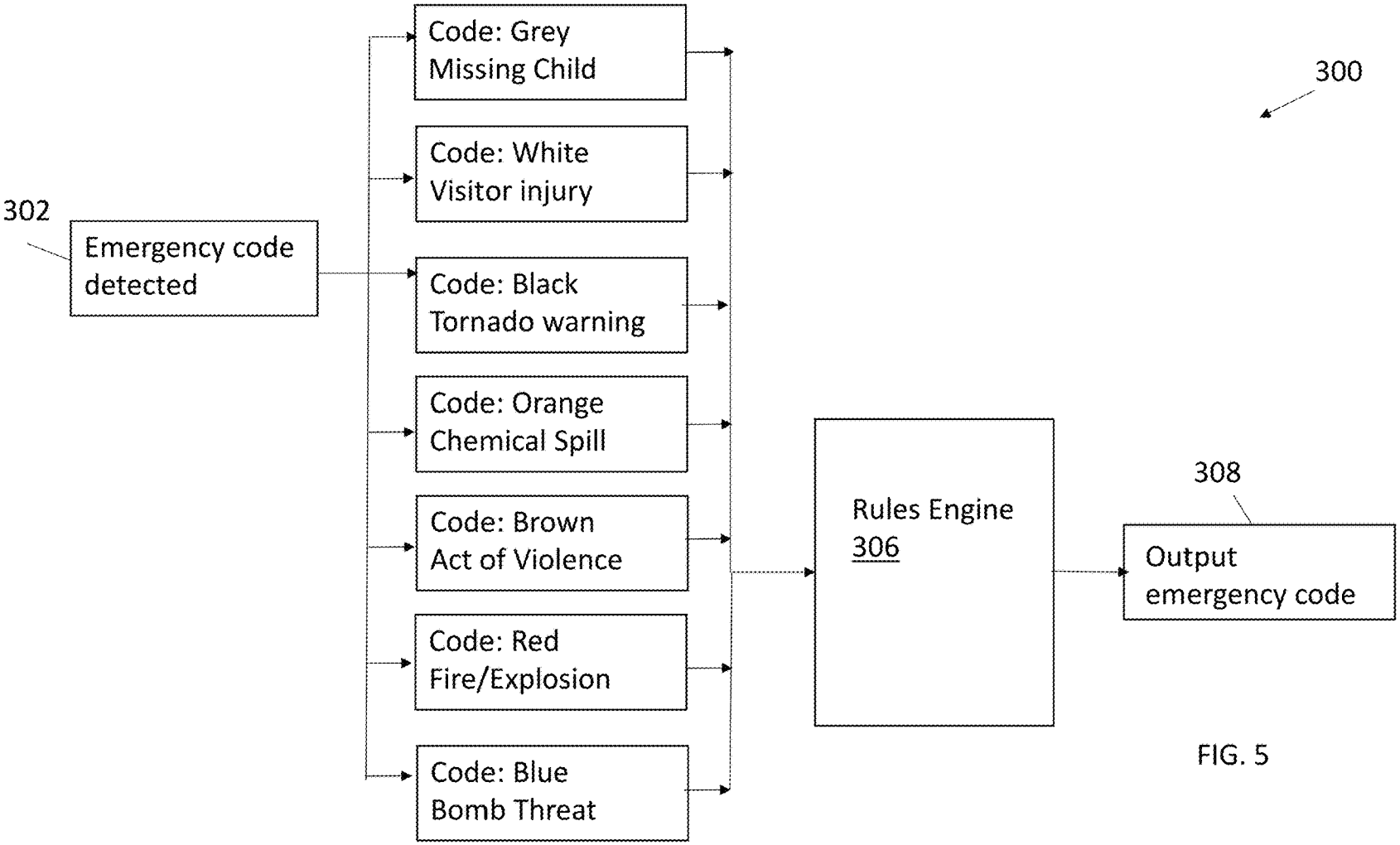
FIG. 5 is a flowchart of a method for notifying a user of a wearable security apparatus of an emergency, in accordance with some embodiments.

FIG. 5 is a flowchart of a method 300 for emergency notification, in accordance with some embodiments. In describing the method 300, reference may be made of elements of FIGS. 1A, 1B, and 2. As described herein, method 300 when applied may be used to notify employees or other wearers of emergencies, or perform security-related procedures such as lockdowns and the like. An associate may trigger an emergency notification by accessing the notification engine 17 with a computer device.

At block 302, an emergency code is detected. The notification engine 17 may include a database of emergency codes, which can be accessed to communicate a code to the wearable device 10. For example, a user may enter a notification to the notification engine 17 that a fire has occurred in the cafeteria of the building. An emergency code may be presented as a color, text, audio, tactile feedback or other form of communication at the wearable device.

A detected emergency code may include a type of emergency. For example, as shown in FIG. 5, an emergency code type may include but not be limited to a missing child, personal injury for example a store associate is injured requiring medical attention, weather warning, such as tornado, hurricane, chemical spill, hazardous material incident, act of violence, fire, explosion, bomb threat, and so on.

At block 306, a rule is executed in response to the detected emergency code. The rule may be stored at the notification engine 17 or other computer in communication with the security system. At block 308, a color coded signal is output to all active wearable devices 10.

In one example, a rule may establish that the wearable device 10 has limited access to an area of a building affected by a chemical spill. Here, the system may be configured to prevent the wearer from opening a door to a room where a chemical spill has occurred. Referring again to block 302, the wearable device 10 may receive a color code, text message or the like indicated that a chemical spill occurred.

In another example, a rule may establish that all employees are allowed to leave the building except those wearing a band that emits a color (for example, brown) indicating that the wearer is a possible shooting suspect. The color code may be generated at the notification engine 17 where information is input identifying a wearer as a possible shooting suspect. Thus, certain wearable devices 10 may have different color codes than other wearable devices.

In other example, a rule may establish that all associates may leave the building. These associates may wear wearable devices 10 indicating a code for a fire, for example, red LEDs.

The following example relates to a company employee who wears a security apparatus that is part of a security system in accordance with some embodiments. The security apparatus may be similar to or the same as the wearable security apparatus described with respect to FIGS. 1A and 1B.

The employee or other authorized accessor of a building is provided with the security apparatus 10, which is configured with a unique ID code that distinguishes the security apparatus 10 from other wearable security apparatuses. For example, a new employee may be assigned during the first day of employment a security apparatus 10 configured as a bracelet or watch that includes a circuit programmed to include a unique ID code. An occupant record pertaining to the employee is stored at the associate registry 14, and includes data such as personal information and identification information, for example, a digital photograph of the employee. When the employee receives the wearable security apparatus 10, for example, on the first day of employment at the building of interest, the occupant record is linked with the wearable apparatus unique ID code, and the link data is stored at the associate registry 14. The employee may also register a fingerprint and/or voice for recognition purposes. For example, fingerprint, voice recognition, and/or other identifier information may be stored at the wearable device 10 for use in a registration process. This identification data may be stored at the associate registry 14. Also, the unique ID code may be added to the building's database that the employee has access to, for example, so that a code can be associated with areas of a building or other location where an employee can access. Thus, the identification data is on file, along with a link between the device ID code and the identification data.

The employee may on a given day plan to go to work. Prior to entering the building, the employee wears the wearable device 10. The wearable device 10 may include sensors 27, for example, tactile sensors, motion sensors, heat sensors, or a combination thereof that sense when the device 10 is placed on the employee's body, for example, about the wrist.

In response to a detection by the sensors 27 of the wearer's presence, a message may be displayed on the display 22 inviting the wearer to authenticate. For example, the wearer can position a finger at a fingerprint scanner at the wearable device 10, or at the biometric reader of another electronic device in communication with the wearable device 10 such as a smartphone or other mobile electronic device. Also, or alternatively, the wearer can enter a personal (PIN) code or other identifier or voice activated command.

The device 10 captures this data and outputs it via the receiver 26 to the authentication server 18 which compares the data to data on file, for example, at the associate registry 14. If the data matches, then the display 22 may display an authentication approval message or the like.

When the employee desires to enter the building, sensors 27 in the floors, walls, and ceiling around a door at a front lobby of the building at which the employee may enter may query the device ID from the wearable device 10, for example, exchange via RFID signals. The sensors 27 in turn output the device ID and the door ID to the authentication server 18. The authentication server 18 determines whether the wearer has access to the door. The location device 28 may establish, by communication via WiFi or the like with other security devices, whether the wearer is at the door and/or whether the wearer is authorized to be in the region of the door. Since the device ID is linked to the door at the front lobby, the door may be unlocked for the wearer to enter the building. In some embodiments, the door is unlocked prior to the wearer reaching door due to the wearer's proximity to the door, and preauthorized to enter a location beyond the door.

The employee enters a user ID and password to log into a computer. The computer may scan for the user ID associated with the wearable device 10 for authentication, for example, three-factor authentication. If the user ID, password, and wearable device are each authenticated, then the employee may be granted access to the computer. In some examples, the the wearable security apparatus 10 includes a biometric reader such as a fingerprint scanner. Even though a wearer receives authorization to enter a building by entering a user ID and password, the wearer apparatus 10 may be ineffective after entering the building if a first wearer gives the apparatus 10 to another occupant, or a second wearer, and the second wearer attempts to enter a location inside the building that is not authorized for the second wearer but otherwise authorized for the first wearer. To prevent the second wearer from accessing this location, the biometric reader can send the second wearer's biometric data to the authentication server 18, which in turn rejects the second wearer's attempt to enter the location unauthorized to the second wearer.

The employee may attempt to enter a room. As he approaches the door, a scanner 12 may communicate with the wearable device 10 to determine whether the user ID is associated with access to the room. The authentication server 18 may determine whether the wearer is authorized to enter the desired location. Here, the employee is not authorized, whereby the door remains locked and his wearable device 10 will vibrate and display a message saying "No access to this door." This message may be displayed after the wearable device 10 is used in an attempt to open the door, i.e., presented to a scanner at the door, or may be displayed prior to the wearer reaching the door via location detection technology.

The employee is in the bathroom when the fire alarm goes off. He doesn't hear the fire alarm and returns to his desk. The fire marshal in charge of the building evacuation queries the access database to verify everyone has left the building. He notices that 99 people entered and 98 exited, suggesting that one person is unaccounted for. The employee's location can be tracked using WiFi triangulation and safely evacuate him. In some embodiments, an authorized user of the wearable apparatus 10 may nevertheless be able to use the apparatus 10 to safely evacuate the building. Here, an override function may be performed that permits anyone to user the wearable apparatus 10. For example, the wearable apparatus 10 may be assigned to a first wearer who lends the apparatus 10 a second wearer. Even though the second wearer cannot access areas of the building not authorized for the second wearer (described in a previous example), the second wearer may be identified by a biometric sensor 27, location data, and so on. The authentication server 18 which stores a record on both the first wearer and the second wearer may provide data to the fire marshall that the second wearer has not be identified as leaving the building when the fire alarm went off.

The access requests mentioned in the foregoing may be logged into an external database system for auditing purposes.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

The invention claimed is:

1. A security system, comprising:

a wearable security apparatus having an electronic display, a storage device that stores data regarding a wearer, an association device that associates the wearer and the apparatus with each other, a transmitter that outputs a signal that accesses a combination of data regarding identification, authentication, location, and access status of the wearer, and a receiver for receiving emergency information;

a security scanner at a facility that communicates with the wearable security apparatus to receive and decode the stored data to determine both a status of the wearer and whether the wearer may enter or leave the facility;

an associate registry that includes registration information regarding the wearer, wherein the security scanner compares the stored data on the wearable security apparatus and the registration information in the associate registry to determine whether the status of the wearer is that the wearer is registered; and an active wearable database that includes employee contact data, wherein the wearer receives the emergency information in response to an emergency code detection, and wherein the active wearable device stores identification data regarding available wearable security apparatuses that are active.

2. The security system of claim 1, wherein the wearable security apparatus is worn about the wearer's wrist.

3. The security system of claim 1, further comprising a check-in database that stores registration status information, wherein the security scanner compares the stored data on the wearable security apparatus and the registration status information in the check-in database to determine whether another person has used the wearable security apparatus to enter the facility.

4. The security system of claim 3, wherein the check-in database is used by the security scanner to confirm from the transmitter data that the wearer checked in so that security scanner can determine whether the wearer is authorized to leave the facility.

5. The security system of claim 1, wherein the wearable security apparatus receives a color coded signal corresponding with the emergency.

6. The security system of claim 1, wherein the color coded signal establishes a level of access or entry by the wearer depending on the emergency.

7. The security system of claim 1, wherein the system relies on security information to notify the wearer of emergencies.

8. The security system of claim 1, wherein the display of the wearable security apparatus displays one or more colors upon detecting an activity.

9. The security system of claim 1, wherein the electronic display includes a plurality of light emitting diodes (LEDs) that emit one or more different colors that coordinate with predetermined codes corresponding to various security-related events.

10. The security system of claim 1, wherein the wearable security apparatus includes a locator that provides a location in the event of an emergency or pre-authentication of the wearer.

11. The security system of claim 1, wherein the wearable security apparatus includes an access control device to determine when the wearer enters or leaves the facility.

12. The security system of claim 1, wherein the wearable security apparatus prevents wearer from scanning other employees when forgetting their badge.

13. The security system of claim 1, wherein the system ensures that another person representing the wearer is not registered using the wearable security apparatus of the wearer.

14. The security system of claim 1, wherein the wearable security apparatus is used to track time while in the facility.

15. The security system of claim 1, further comprising a notification engine that includes a database of emergency codes, which are accessed to communicate a code to the wearable security apparatus.

16. The security system of claim 1, wherein the associate registry stores an occupant record that includes a link to a wearable security apparatus identifier.

17. A security system, comprising:

a wearable security apparatus having an electronic display, a storage device that stores data regarding a wearer, an association device that associates the wearer and the apparatus with each other, a transmitter that outputs a signal that accesses a combination of data regarding identification, authentication, location, and access status of the wearer, and a receiver for receiving emergency information;

a security scanner at a facility that communicates with the wearable security apparatus to receive and decode the stored data to determine both a status of the wearer and whether the wearer may enter or leave the facility; and an associate registry that includes registration information regarding the wearer, wherein the security scanner compares the stored data on the wearable security apparatus and the registration information in the associate registry to determine whether the status of the wearer is that the wearer is registered, wherein the electronic display includes a plurality of light emitting diodes (LEDs) that emit one or more different colors that coordinate with predetermined codes corresponding to various security-related events.

18. A security system, comprising:

a wearable security apparatus having an electronic display, a storage device that stores data regarding a wearer, an association device that associates the wearer and the apparatus with each other, a transmitter that outputs a signal that accesses a combination of data regarding identification, authentication, location, and access status of the wearer, and a receiver for receiving emergency information;

a security scanner at a facility that communicates with the wearable security apparatus to receive and decode the stored data to determine both a status of the wearer and whether the wearer may enter or leave the facility;

an associate registry that includes registration information regarding the wearer, wherein the security scanner compares the stored data on the wearable security apparatus and the registration information in the associate registry to determine whether the status of the wearer is that the wearer is registered; and a notification engine that includes a database of emergency codes, which are accessed to communicate a code to the wearable security apparatus.

* * * * *